US006089625A

United States Patent [19]

Prevot et al.

[11] Patent Number: 6,089,625

[45] Date of Patent: Jul. 18, 2000

[54] FITTING FOR SLIDING CLOSURE

[75] Inventors: Gérard Prevot, Willerwald; Gérard Desplantes, Sarrebourg; Eric Alvarez, Hommert, all of France

[73] Assignee: Ferco International Ferrures et Serrures de Batiment, Reding, France

[21] Appl. No.: 09/054,827

[22] Filed: Apr. 3, 1998

[30] Foreign Application Priority Data

Apr. 3, 1997 [FR] France ..... 97 04067

[51] Int. Cl.[7] ..... E05C 1/06

[52] U.S. Cl. ..... 292/182; 292/165; 292/140

[58] Field of Search ..... 292/165, 166, 292/173, 174, 139, 143, DIG. 30, DIG. 31, DIG. 49, DIG. 63, DIG. 72, 182

[56] References Cited

U.S. PATENT DOCUMENTS

| | | | |
|---|---|---|---|
| Re. 14,741 | 10/1919 | Anderson | 292/219 |
| 1,116,617 | 11/1914 | Page | 292/139 |
| 1,917,159 | 7/1933 | Schaaf | 292/173 |
| 2,588,356 | 3/1952 | Burgoyne | 292/182 |
| 3,050,322 | 8/1962 | Miller . | |
| 3,222,897 | 12/1965 | Du Shane, Jr. . | |
| 4,343,501 | 8/1982 | Meeks | 292/113 |
| 4,508,377 | 4/1985 | Takasaki | 292/166 |
| 4,704,882 | 11/1987 | Takasaki | 292/173 |
| 4,790,157 | 12/1988 | Lin . | |
| 5,301,989 | 4/1994 | Dallman et al. | 292/142 |
| 5,823,583 | 10/1998 | Sandhu et al. | 292/165 |

FOREIGN PATENT DOCUMENTS

| | | | |
|---|---|---|---|
| 669537 | 8/1929 | France | 292/143 |
| 2397503 | 3/1979 | France | 292/143 |
| 2712337 | 5/1995 | France . | |

*Primary Examiner*—Teri Pham
*Attorney, Agent, or Firm*—Kenyon & Kenyon

[57] ABSTRACT

In a lock for sliding closures a maneuvering member is mounted to pivot about a pivot pin passing through the casing in the transverse direction of a slot and the maneuvering member and the bolt-carrier include, in the case of one of them, a cam surface and, in the case of the other of them, a ram follower roller which cooperates with the cam surface to enable sliding of the bolt-carrier in one direction or the other when the maneuvering member pivots in one direction or the other about its pivot pin.

16 Claims, 3 Drawing Sheets

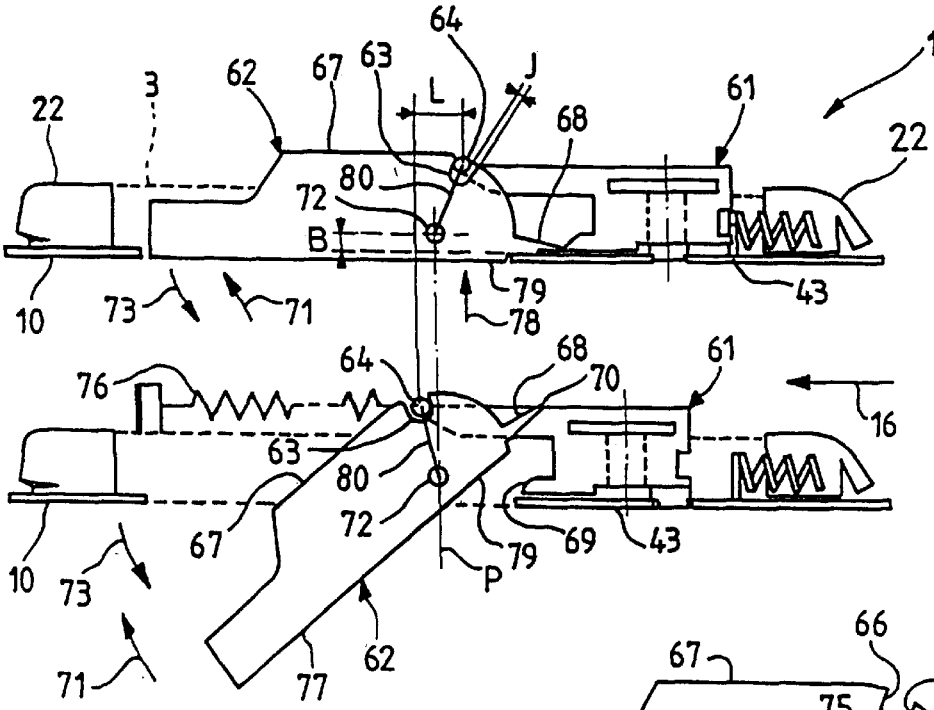
FIG_11
FIG_12
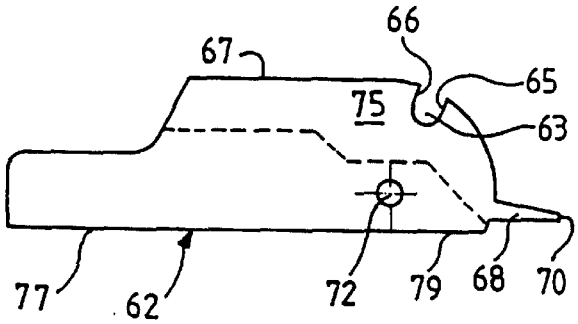
FIG_13
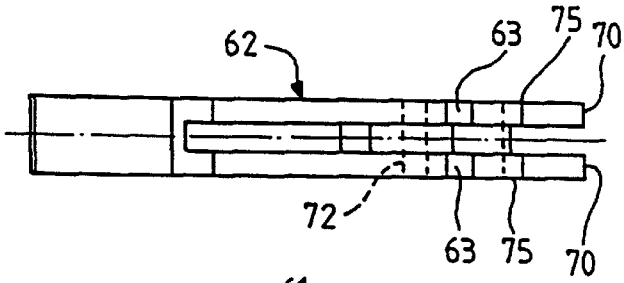
FIG_14
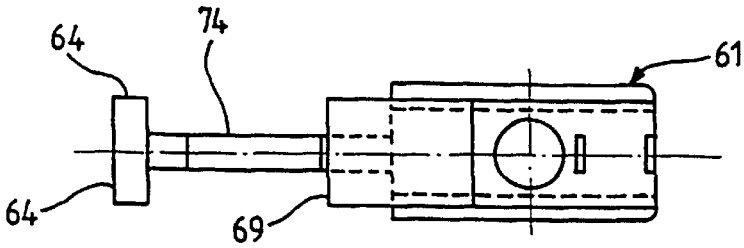
FIG_16
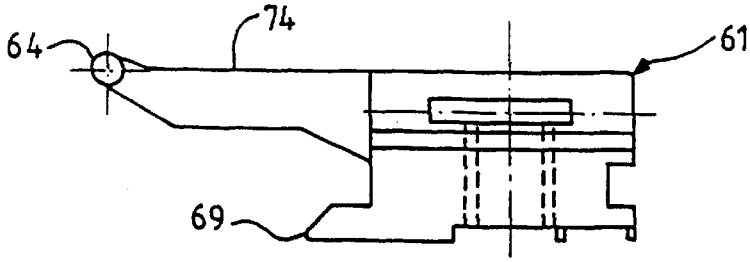
FIG_15

FITTING FOR SLIDING CLOSURE

BACKGROUND OF THE INVENTION

1. Field of the Invention

The present invention concerns a fitting for sliding door, window or like closures.

To be more precise, the invention concerns a fitting for a sliding door, window or like closure including an elongate casing adapted to be inserted into an elongate slot in the inside wall of said closure, a bolt-carrier adapted to slide longitudinally inside the casing and a maneuvering member for sliding the bolt-carrier between a locked position and an unlocked position in which the closure can slide, a longitudinal slot being provided in the outside plate of the casing to enable actuation of the maneuvering member.

2. Description of the Prior Art

In a standard prior art implementation a slider attached to the bolt-carrier and mobile inside the casing includes a maneuvering member in the form of a cavity with a concave back facing a slot in the outside plate of the casing: the fingers are inserted through the slot to access the back of the cavity to move the slider and the bolt-carrier in one direction or the other.

Fittings of the above type available off-the-shelf correspond to two standard values of the width of the opening in the closure (16 mm and 20 mm). These two standardized dimensions oblige fitting manufacturers to offer a complete range of their products for each dimension, which is costly. Furthermore, for the smaller, 16 mm dimension the limited width of the slot makes access to the handle difficult for persons having relatively large fingers.

The aim of the present invention is to remedy the drawbacks of the prior art implementations and to propose a fitting of the above type with a simple and reliable structure avoiding the need to insert the fingers into the slot in the casing and usable for both widths of the opening in the closure.

SUMMARY OF THE INVENTION

In accordance with the present invention in a fitting of the above type the maneuvering member is mounted to pivot abort a pivot pin passing through the casing in the transverse direction of the slot and the maneuvering member and the bolt-carrier include, in the case of one of them, cam surface means and, in the case of the other of them, cam follower roller means adapted to cooperate with the cam surface means to enable sliding of the bolt-carrier in one direction or the other when the maneuvering member pivots in one direction or the other about its pivot pin.

Accordingly, the cam means of the maneuvering member and the bolt-carrier mean that all sliding members other than the bolt-carrier can be dispensed with. Pivoting of the maneuvering member in one direction or the other allows sliding of the bolt-carrier in one direction or the other. It is therefore no longer necessary to insert the fingers into the slot to press on the back of the cavity of the conventional slider in order to move the slider.

Also, it is very easy to design a fitting in accordance with the invention that suits the narrower, 16 mm width of the slot in the closure: this fitting, with no problem of access to the maneuvering member, can be used without modification for the larger, 20 mm width of the slots in the closure.

In an advantageous version of the invention, the cam follower roller and the cam surface include respective complementary shaped portions adapted to engage with each other to immobilize the bolt-carrier in its locked position and to leave their inter-engaged position when the maneuvering member is maneuvered in the unlocking direction.

In a preferred version of the invention the fitting includes spring means adapted to spring-load the bolt-carrier in the unlocking direction.

Accordingly, when the bolt-carrier and the maneuvering member are in their respective immobilized locked positions slight pivoting of the maneuvering member in the unlocking direction is sufficient to push the bolt-carrier back in the locking direction against the spring means to release the bolt-carrier. The maneuvering member can then be released, the spring means returning the bolt-carrier and said member to their respective unlocked positions.

Other features and advantages of the present invention will become apparent in the following detailed description given by way of non-limiting example only with reference to the appended drawings.

BRIEF DESCRIPTION OF THE DRAWINGS

FIG. 11 is a diagrammatic view similar to FIG. 2 of another embodiment of the invention showing the bolt-carrier in its locked closed position.

FIG. 12 is a view similar to FIG. 11 showing the bolt-carrier in its unlocked position and the handle also in its unlocked position.

FIG. 13 is a view of a detail from FIG. 11 showing the handle in elevation.

FIG. 14 is a top view of the handle from FIG. 13.

FIG. 15 is a view in elevation of the bolt-carrier from FIG. 11.

FIG. 16 is a bottom view of the bolt-carrier from FIG. 15.

DETAILED DESCRIPTION OF THE PREFERRED EMBODIMENTS

Figures 1, 2, 3, 4, 5, 6:
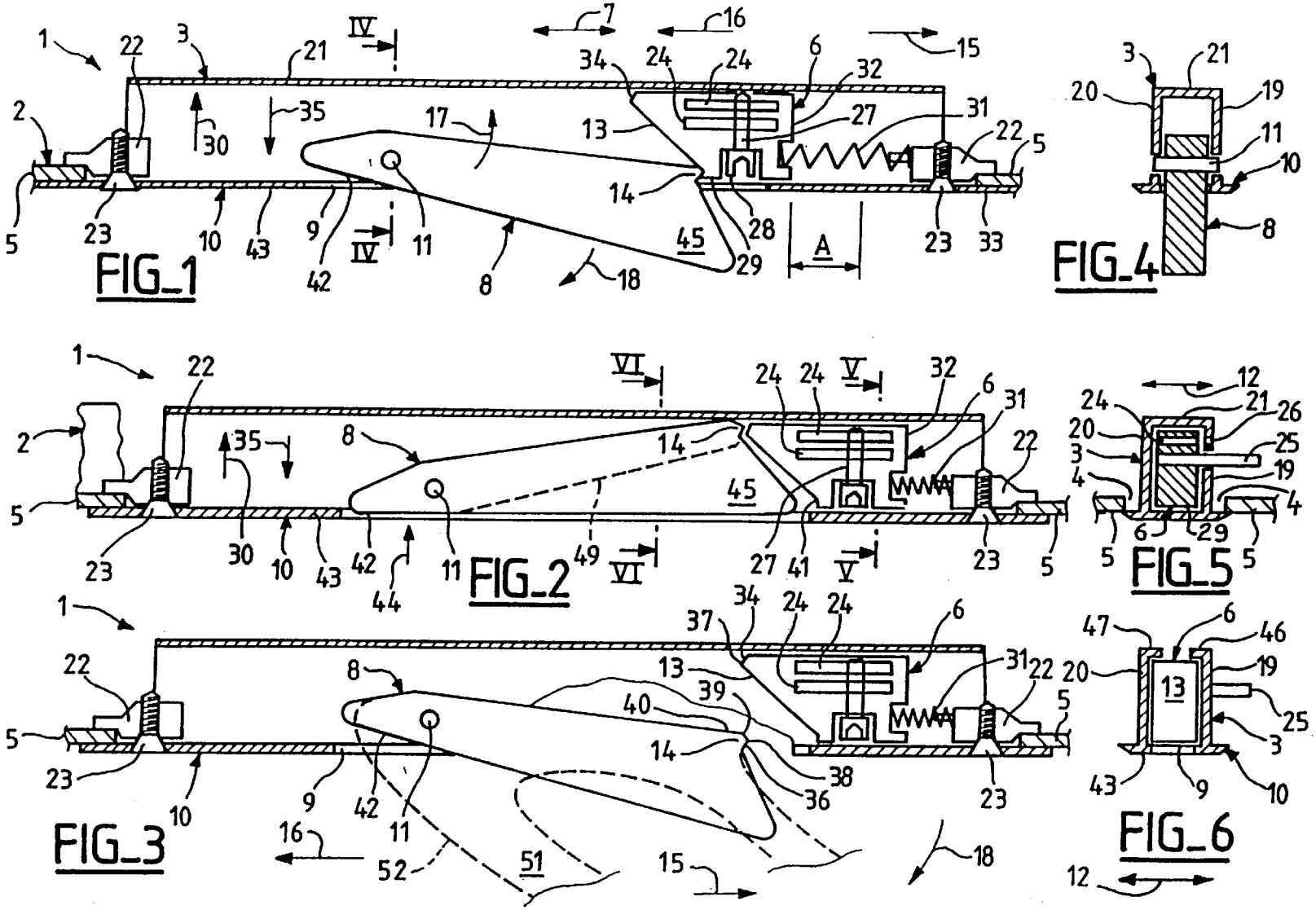
FIG. 1 is a diagrammatic view in longitudinal section of a fitting constituting one embodiment of the present invention, the handle and the bolt-carrier being shown in their respective unlocked positions.
FIG. 2 is a view similar to FIG. 1 showing the handle and the bolt-carrier in their respective locked positions.
FIG. 3 is a cut-away view similar to FIG. 1 showing the bolt-carrier in its locked position and the handle in its unlocked position, to make the figure clear.
FIG. 4 is a view in section taken along the line IV—IV in FIG. 1.
FIG. 5 is a view in section taken along the line V—V in FIG. 2.
FIG. 6 is a view in section taken along the line VI—VI in FIG. 2 of a different embodiment of the present invention.

In the embodiment shown in FIGS. 1 through 5 the fitting 1 for sliding door, window or like closures 2 includes an elongate parallelepiped-shape casing 3 adapted to be inserted into an elongate slot 4 in the inside front wall 5 of the stile of said closure 2, a bolt-carrier 6 adapted to slide in the longitudinal direction 7 inside the casing 3 and a maneuvering member 8 for moving the bolt-carrier 6 a distance A (see FIG. 1) between a locked position shown in FIG. 2 and an unlocked position shown in FIG. 1 in which the closure 2 can slide. A longitudinal slot 9 is formed in the outside embellisher plate 10 of the casing 3 to enable actuation of the maneuvering member 8.

As shown in FIG. 4 in particular the casing 3 includes, in addition to the outside plate 10 adapted to cover the slot 4, two lateral walls 19, 20 and a back 21. The back 21 and the plate 10 are parts of an extrusion made from light alloy, for example.

The casing 3 is fixed to the wall 5 of the closure 2 in a conventional way using prior art fixing members 22 that cooperate with a screw 23 to grip the wall 5 between the outside plate 10 and the fixing member 22 when the screw 23 is tightened.

The bolt-carrier 6 includes at least one housing 24 adapted to receive a bolt 25 (see FIG. 5) of any type projecting from the casing 3 through a slot 26 in the lateral wall 19 of the casing 3.

A grub screw 27 for immobilizing the bolt 25 in the housing 24 in the bolt-carrier 6 is inserted into a hole 28 in the face 29 of the bolt-carrier 6 facing the outside plate 10.

In accordance with the present invention the maneuvering member 8 is a handle pivoting on a pivot pin 11 passing through the lateral walls 19, 20 of the casing 3 in the transverse direction 12 of the slot 4 (see FIG. 4). The bolt-carrier 6 includes cam surface means 13 and the handle 8 includes cam follower roller means 14 adapted to cooperate with the cam surf ace means 13 to slide the bolt-carrier 6 in the locking direction 15 or in the unlocking direction 16 when the handle 8 pivots in the locking direction 17 or in the unlocking direction 18 about its pivot pin 11.

In the example shown in FIGS. 1 to 3 the bolt-carrier 6 has a transverse face 13 forming a cam surface facing in the unlocking direction 16 and consisting of a surface extending generally in said unlocking direction 16 and in the direction 30 towards the back 21 of the casing 3.

The fitting 1 includes means for immobilizing the bolt-carrier 6 in the locked position shown in FIG. 2 and means for releasing the bolt-carrier 6 from said locked position.

To this end the cam follower roller 14 and the cam surface 13 include respective complementary shaped portions adapted to engage with each other to immobilize the bolt-carrier 6 in its locked position shown in FIG. 2 and to extract them from their inter-engaged position when the handle 8 is maneuvered in the unlocking direction 18.

As shown in FIGS. 1 to 3 the fitting 1 includes spring means 31 adapted to spring-load the bolt-carrier 6 in the unlocking direction 16.

In this example the spring means 31 are between the transverse face 32 of the bolt-carrier 6 facing in the locking direction 15 and at the opposite end relative to the face 13 and the fixing member 22 at the end 33 of the casing 3 in said locking direction 15.

In the example shown the handle 8 has a shaped portion 36 which in the locked position of the handle 8 shown in FIG. 2 is near the back 21 of the casing 3 and extends in the locking direction 15 and in the direction 30 towards the back 21 of the casing 3.

The bolt-carrier 6 has a complementary shaped portion 34 adapted to transmit the thrust of the spring 31 to said shaped portion 36 of the handle 8 to press the handle 8 against the back 21 of the casing 3.

FIGS. 1 to 3 show that the transverse face 13 of the bolt-carrier 6 facing in the unlocking direction 16 forms near the back 21 of the casing 3 a projecting dihedron 37 extended towards said back 21 by a surface portion 34 extending in the locking direction 15 and in the direction 30 towards said back 21.

In this example the shaped portions 34 and 36 of the bolt-carrier 6 and of the handle 8 are parallel plane portions so that the contact between the two shaped portions occurs over all of the surface thereof. Accordingly the force from the spring 31 is transmitted by the shaped portion 34 to the shaped portion 36. The component of this force perpendicular to the surface 36 is made up of a component directed in the direction 30 towards the back 21 of the casing 3 which presses the handle 8 against the back 21 and a component in the unlocking direction 16 which is transmitted to the pivot pin 11 of the handle 8 and is compensated by the opposing resistance of said pin 11.

Additional immobilization is naturally assured by the fact that in the locked position shown in FIG. 2, the shaped portions 34 and 36 are offset relative to the pivot pin 11 of the handle 8 in the direction 30 towards the back 21 of the casing 3.

The resulting immobilized locked position of the bolt-carrier 6 is therefore extremely stable and capable of resisting impact and vibration in the case of an attempted break-in.

The shaped portion 36 of the handle 8 is extended towards the back 21 of the casing 3 by a projecting dihedron 38 and by a surface portion 39 extending in the unlocking direction 16 and in the direction 30 towards said back 21.

This surface portion 39 includes a region 40 which, in the locked position of the handle 8 shown in FIG. 2, comes into contact with the back 21 of the casing 3.

Accordingly, it is clear that to slide the bolt-carrier 6 to the locked position it is sufficient to turn the handle 8 in the locking direction 17, which is the anticlockwise direction in FIGS. 1 to 3. The projecting dihedron 38 and the surface portion 39 slide along the transverse face 13 of the bolt-carrier 6 and push the latter back in the locking direction 15 to the immobilized locked position of FIG. 2 in which the region 40 is pressed against the back 21 of the casing 3 by the pressure exerted by the shaped portion 34 on the shaped portion 36.

The transverse face 13 of the bolt-carrier 6 facing in the unlocking direction 16 forms near the outside plate 10 of the casing 3 a re-entrant dihedron 41 the function of which is described below.

As shown in FIG. 2 the handle 8 is shaped to be completely or almost completely accommodated within the casing 3 in its locked position.

It is therefore possible to grasp the handle 8 to release the bolt-carrier from its immobilized locked position shown in FIG. 2.

Under these conditions the handle 8 includes a bearing region 42 substantially opposite the shape portion 36 relative to the pivot pin 11 of the handle 8. This bearing region 42 is shaped so that in the locked position of the handle 8 shown in FIG. 2 the region 42 is substantially flush with the outside surface 43 of the outside plate 10 of the casing 3.

It is then sufficient to apply pressure, as symbolized by the arrow 44 in FIG. 2, to the region 42 of the handle 8 in the direction 30 towards the back 21 of the casing 3 to pivot the handle 8 in the unlocking direction 18, which is the anticlockwise direction in this figure: this presses the shaped portion 36 of the handle 8 onto the shaped portion 34 of the bolt-carrier 6 which pushes the bolt-carrier 6 back slightly in the locking direction 15 against the force of the spring 31. Because of this slight retraction of the bolt-carrier 6, the shaped portion 36 escapes from the shaped portion 34, which releases the bolt-carrier 6 from its locked position.

The force of the spring 31 is then sufficient to push the bolt-carrier 6 back in the unlocking direction 16. This sliding of the bolt-carrier 6 obliges the projecting dihedron 38 of the handle 8 to slide along the surface 13 of the bolt-carrier until said projecting dihedron 38 is received in the re-entrant dihedron 41 of the surface 13 of the bolt-carrier to immobilize the bolt-carrier 6 in the unlocked position shown in FIG. 1.

In FIG. 1 the part 45 of the handle 8 projecting out of the casing 3 can be grasped to slide the sliding closure 2.

In the variant shown in FIG. 6 the back 21 of the casing 3 comprises two flanges 46, 47 projecting towards each other at the extremities of the lateral walls 19 and 20 of the casing 3.

Figures 7, 8, 9, 10:
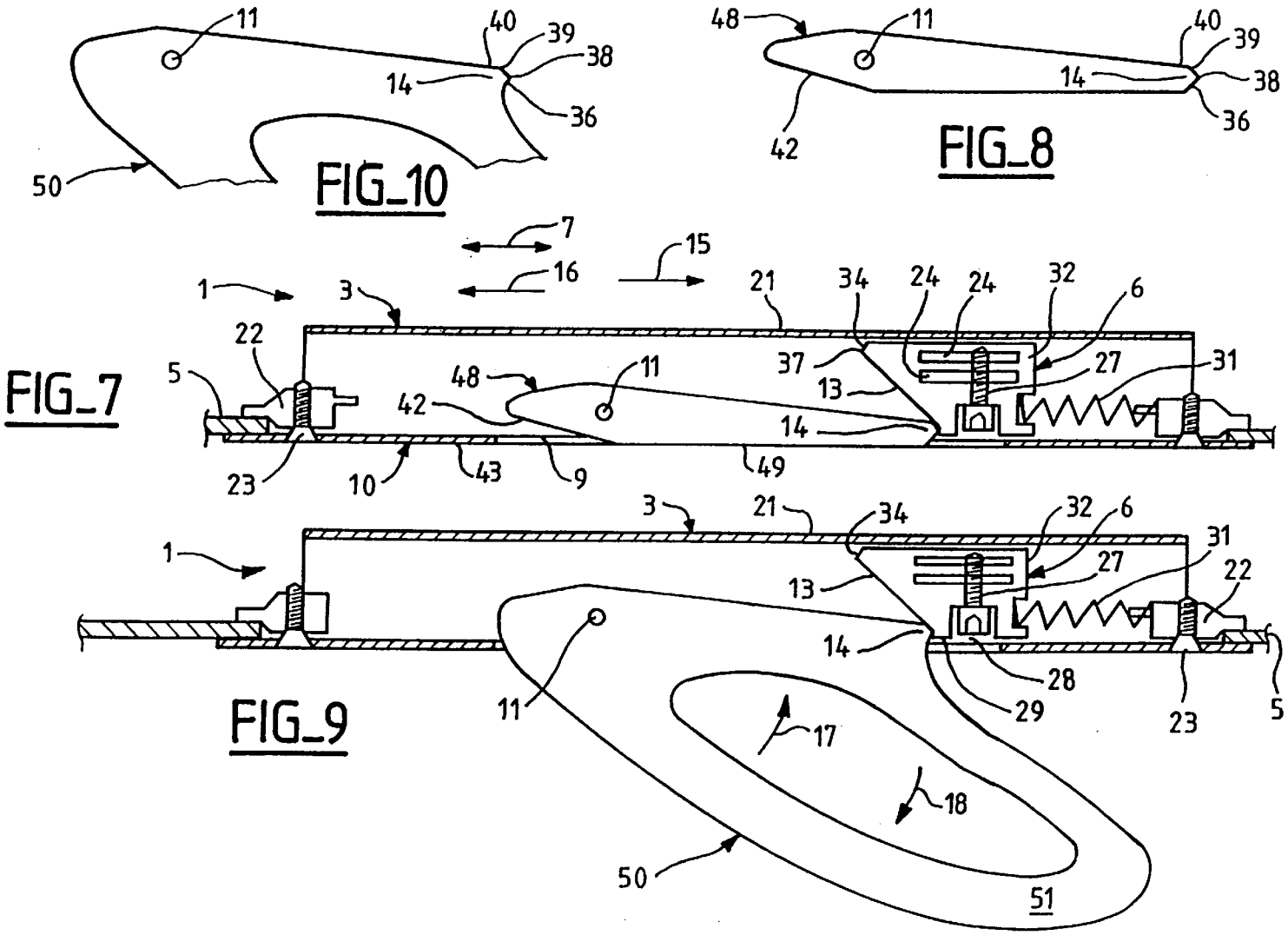
FIG. 7 is a view similar to FIG. 1 of another embodiment of the present invention.
FIG. 8 is a view of a detail from FIG. 7.
FIG. 9 is a view similar to FIG. 1 of another embodiment of the present invention.
FIG. 10 is a view of a detail from FIG. 9.

In the embodiment shown in FIGS. 7 and 8 the handle 48 has a profile corresponding to that of the handle 8 truncated along the dashed line 49 in FIG. 2 and without the previously mentioned part 45.

The handle 48 therefore has the shaped portion 36, the projecting dihedron 38, the extension 39 and the region 40 which cooperate with the bolt-carrier 6 to lock the latter in its locked position shown in FIG. 2. The handle 48 also has the bearing region 42 enabling the bolt-carrier 6 to be released.

Everything described above in respect of locking, immobilizing, releasing and unlocking the bolt-carrier 6 by means of the handle 8 can therefore be transposed to the handle 48.

On the other hand, the handle 48 cannot be used to slide the sliding closure 2. In this case the fitting is completed by a pull-handle, not shown.

In the embodiment shown in FIGS. 9 and 10 the handle 50 has, like the handles 8 and 48, shaped portions 36, 38, 39 and 40 that cooperate with the bolt-carrier 6 to lock it and to immobilize it in the locked position.

To show clearly the resemblances and differences between the handle 50 and the handle 8, the contour of the handle 50 which is different from that of the handle 83 is shown in dashed line at 52 in FIG. 3.

The handle 50 has a projecting part 51 of any shape that projects out of the casing 3 and which is therefore easy to maneuver to lock and immobilize the bolt-carrier 6 or to release and unlock it.

The handle 50 can easily be used to maneuver the slide enclosure 2.

The handle 50 can obviously have any shape and style to suit the esthetic preferences of customers.

In the embodiment shown in FIGS. 11 to 16 the bolt-carrier 61 and the handle 62 include a slot 63 in one of them and a cam follower roller 64 on the other of them adapted to move in the slot 63. The cam follower roller 64 and the slot 63 are such that the cam follower roller 64 slides along opposite walls 65, 66 of the slot 63 when the handle 62 pivots and the bolt-carrier 61 slides.

In this example the slot 63 is on the handle 62 and the cam follower roller 64 is attached to the bolt-carrier 61. The opposite arrangement is equally possible.

FIGS. 11 to 14 show that the slot 63 opens onto the periphery of the handle 62 (or of the bolt-carrier 61 in the converse arrangement), on the edge 67 of the latter on the same side as the back 21 of the casing 3.

To immobilize the bolt-carrier in its locked position shown in FIG. 11 the handle 62 includes at least one finger 68 extending longitudinally in the locking direction 15 and the bolt-carrier 61 includes a surface element 69 forming an abutment that comes into contact with the free end 70 of the finger 68 in the locked position of the bolt-carrier 61 to immobilize the latter in said locked position.

The finger 68 and the abutment 69 are such that in the locked position of the bolt-carrier 61 and of the handle 62 the force exerted by the abutment 69 on the finger 68 urges the handle 62 in the locking direction 71 which is the clockwise direction in FIGS. 11 and 12.

FIG. 11 shows that in the locked position of the bolt-carrier 61 the free end 70 of the finger 68 is offset relative to the pivot pin 72 of the handle 62 in the direction 35 away from the back 21 of the casing 3. This offset B (see FIG. 11) constitutes the space available for immobilizing the bolt-carrier 61 in its locked position shown in FIG. 11.

FIG. 11 also shows that in the immobilized locked position of the bolt-carrier 61 and of the handle 62 shown in FIG. 11 there is a clearance i between the cam follower roller 64 and the corresponding wall 65 of the slot 63. The clearance J is predetermined to allow rotation of the handle 62 in the unlocking direction 73 through a small angle sufficient for the free end 70 of the finger 68 to escape from the abutment 69 in order to release the handle 62 and the bolt-carrier 61 from the locked position.

As stated above, in the present example, the slot 63 is a notch in the edge 67 of the handle 62 and the cam follower roller 64 is attached to the bolt-carrier 61. As shown in detail in FIGS. 13 to 16 the bolt-carrier 61 includes a central arm 74 extending longitudinally in the unlocking direction 16. The handle 62 includes two transverse flanges 75 on respective opposite sides of the arm 74. Each flange 75 includes a notch 63 that cooperates with a respective roller 64 mounted at the end of the arm 74.

FIGS. 11 and 12 show that the respective positions of the rollers 64 in the unlocked and locked positions of the bolt-carrier 61 and of the handle 62 are at a distance L from each other on respective opposite sides of the transverse plane P of the casing 3 containing the pivot pin 72 of the handle 62. Because of this feature the radius 80 from the pivot pin 72 of the handle 62 to the rollers 64 is always substantially perpendicular to the longitudinal direction 7 of the casing 3 and of the central arm 74 of the bolt-carrier 61, assuring optimal conditions for cooperation between the rollers 64 and the notches 63 and therefore between the bolt-carrier 61 and the handle 62.

A spring shown diagrammatically at 76 is advantageously provided to spring-load the bolt-carrier in the unlocking direction 16.

In the example shown, in which, in the locked position of the handle, the outside edge 77 of the handle 62 opposite the edge 67 is substantially flush with the outside surface 43 of the outside plate 10, to unlock and move the bolt-carrier 61 and the handle 62 it is sufficient to apply pressure, symbolized by the arrow 78, to the bearing region 79 of the handle 62 on the locking direction 15 side of the pivot pin 72 of the handle 62.

A simple and relatively reliable fitting has been described that can be sized to suit the narrower, 16 mm standard width of the standard slots in sliding closures and that can be used in the same way in the wider slots.

In the embodiments of FIGS. 1 through 10 sliding of the bolt-carrier 6 results from pivoting of the handle in the locking direction and from pivoting of the handle in the opposite direction, assisted by a spring, to achieve unlocking.

In the embodiment of FIGS. 11 through 16 sliding of the bolt-carrier 61 is the result of pivoting of the handle 62, optionally assisted in the unlocking direction by a spring 76 conferring optional automatic operation.

The handle 8, 48, 50, 62 of the fitting can easily satisfy the ergonomic conditions necessary for easy maneuvering of the sliding closure 2.

Except in the case of the handle 48, the fitting eliminates all pull-handles on the sliding closure.

The fitting can be designed with very varied shapes and styles providing great possibilities of customizing the fitting.

Of course, the present invention is not limited to the embodiments just described and many changes and modifications can be made to the latter without departing from the field of the invention.

The maneuvering member 8, 48, 50 includes a shaped portion 36 which in the locked position of the maneuvering member 8, 48, 50 is near the back 21 of the casing 3 and extends in the locking direction 15 and in the direction 35 away from the back 21 of the casing.

What is claimed is:

1. A fitting for a sliding closure comprising an elongate casing adapted to be inserted into an elongate slot in an inside wall of a stile of said closure, a bolt-carrier having a bolt disposed therein, said bolt extending perpendicular to said bolt-carrier, and adapted to slide in a longitudinal direction inside said casing and a maneuvering member for sliding said bolt-carrier between a locked position and an unlocked position, a longitudinal slot provided in an outside plate of said casing to enable actuation of said maneuvering member, which is mounted to pivot about a pivot pin passing through said casing in a transverse direction of said slot and wherein one of said maneuvering member and said bolt-carrier includes first cam means and the other of said maneuvering member and said bolt-carrier includes second cam means adapted to cooperate with said first cam means to enable sliding of said bolt-carrier in one direction or another when said maneuvering member pivots in one direction or another about said pivot pin, said fitting further including longitudinally extending spring means adapted to spring-load said bolt-carrier in a longitudinal unlocking direction and wherein said maneuvering member includes means for immobilizing said bolt-carrier in said locked position formed integra with said maneuvering member and wherein said bolt-carrier includes engagement means adapted, in said locked position of said bolt-carrier and said maneuvering member, to be pressed in said longitudinal unlocking direction against said maneuvering member immobilizing means, said engagement means of said bolt-carrier resiliently engageable with said maneuvering member immobilizing means in order to prevent a rotation of said maneuvering member in said unlocking direction and resiliently disengagable from said corresponding maneuvering member immobilizing means upon said maneuvering member being rotated by a small angle in an unlocking pivoting direction from a locked position.

2. The fitting of claim 1 wherein said maneuvering member immobilizing means is included on said second cam means and said bolt carrier engagement means is included on said first cam means.

3. The fitting of claim 1 wherein said spring means is located between a transverse face of said bolt-carrier facing in a locking direction and a fixing member located at a locking direction end of said casing.

4. The fitting of claim 1 wherein said maneuvering member includes a shaped portion which, in a locked position of said maneuvering member, is near a back of said casing and extends in a locking direction and extends in a direction away from the back of said casing; and said bolt-carrier includes a complementary shaped portion adapted to transmit a thrust of said spring means to said shaped portion of said maneuvering member to press said maneuvering member against said back of said casing.

5. The fitting of claim 4 wherein said shaped portion of said maneuvering member is extended towards said back of said casing by a projecting dihedron and by a surface portion extending in said unlocking direction and in a direction towards said back of said casing.

6. The fitting of claim 4 wherein said maneuvering member, is in said locked position housed at least partially inside said casing said maneuvering member including a bearing region substantially opposite said shaped portion relative to said pivot pin and said bearing region shaped so that in said locked position of said maneuvering member said bearing region is substantially flush with an outside surface of said outside plate of said casing.

7. The fitting of claim 1 wherein said bolt-carrier includes a transverse face facing in said unlocking direction consisting of a surface extending generally in said unlocking direction and in a direction towards a back of said casing.

8. The fitting of claim 7 wherein said transverse face of said bolt-carrier includes near said back of said casing, a projecting dihedron which is extended towards said back of said casing by a surface portion extending in a locking direction and in said direction towards said back of said casing.

9. The fitting of claim 7 wherein said transverse face of said bolt-carrier, includes near said outside plate of said casing, a re-entrant dihedron.

10. The fitting of claim 1 wherein said first cam means is a cam slot and said second cam means is a cam follower roller adapted to move in said cam slot, wherein said cam follower roller slides along opposite walls of said cam slot when said maneuvering member pivots and said bolt-carrier slides.

11. The fitting of claim 10 wherein said cam slot opens onto a periphery of said maneuvering member or said bolt-carrier.

12. The fitting of claim 10 wherein said maneuvering member immobilizing means includes at least one finger extending longitudinally in a locking direction and wherein said bolt-carrier engagement means includes an abutment surface element that comes into contact with a free end of said at least one finger in said locked position of said bolt-carrier to immobilize said bolt-carrier in said locked position.

13. The fitting of claim 12 wherein in said locked position of said bolt-carrier and of said maneuvering member, a force exerted by said abutment surface element on said at least one finger urges said maneuvering member in said locking direction.

14. The fitting of claim 12 wherein in said locked position of said bolt-carrier and of said maneuvering member there is a clearance between said cam follower roller and a corresponding wall of said cam slot, said clearance being predetermined to allow rotation of said maneuvering member in said unlocking direction through a small angle sufficient for said free end of said at least one finger to escape from said abutment surface element to release said maneuvering member and said bolt-carrier from said locked position.

15. The fitting of claim 10 wherein said cam slot is a notch in said maneuvering member, said cam follower roller is attached to said bolt-carrier, said bolt-carrier including a central arm extending longitudinally in said unlocking direction and said maneuvering member including two flanges disposed transversely on respective opposite sides of said arm, each flange carrying a flange notch that cooperates with a respective roller mounted at an end of said arm.

16. The fitting of claim 15 wherein said respective positions of said rollers in said unlocked and locked positions of said bolt-carrier and of said maneuvering member are on respective opposite sides of a transverse plane of said casing containing a rotation axis of said maneuvering member.

* * * * *